United States Patent [19]

Barcant

[11] 4,167,898

[45] Sep. 18, 1979

[54] ILLUMINATION AND VENTILATION SYSTEM FOR BUILDINGS

[76] Inventor: Kevin C. Barcant, 10A Stephens Rd., Maraval, Trinidad and Tobago

[21] Appl. No.: 646,903

[22] Filed: Jan. 6, 1976

[51] Int. Cl.[2] ..... F24F 13/00

[52] U.S. Cl. ..... 98/32; 98/74; 98/37; 49/31; 49/135

[58] Field of Search ..... 98/32, 37, 121 A, 74, 98/121 R, 77, 119; 49/31, 135; 52/204

[56] References Cited

U.S. PATENT DOCUMENTS

| | | | |
|---|---|---|---|
| 18,100 | 9/1857 | Maykew | 98/74 |
| 90,180 | 5/1869 | Mend | 98/74 |
| 532,452 | 1/1895 | Elwell | 98/37 |
| 614,368 | 11/1898 | Cramer | 98/74 |
| 827,030 | 7/1906 | Noblett | 98/32 |
| 1,254,517 | 1/1918 | Lumm | 98/119 |
| 1,672,291 | 6/1928 | Williams | 98/74 |
| 3,521,546 | 7/1970 | Day | 98/32 |
| 3,822,637 | 7/1974 | Whitlock | 98/74 |

*Primary Examiner*—Henry C. Yuen

*Attorney, Agent, or Firm*—Richard J. Birch

[57] ABSTRACT

An illumination and ventilation system for buildings and other enclosures utilizing at least one closure unit mounted in one or more sides of the building or other enclosure. The closure unit has a frame within which are a plurality of pivotally mounted, independently, movable, downwardly extending, blades. The blades are mounted within the frame with the pivot axii of the blades parallel and lying in a sloping plane when the closure unit is installed in the side of a building, or other enclosure. In a rectangular plan building or enclosure, four or more closure units should be employed; one or two for the windward side or sides, and three or two for the nonwindward and leeward sides. With this system, the windward and leeward and nonwindward closure units, will operate independently of each other and will be individually responsive to the net resultant wind pressures on each side of the building. Because the movement of the closure unit blades on any side of a building are also equally controlled by gravity, the dominant control of each closure is determined by wind conditions.

9 Claims, 8 Drawing Figures

ILLUMINATION AND VENTILATION SYSTEM FOR BUILDINGS

BACKGROUND OF THE INVENTION

Figure 1A:
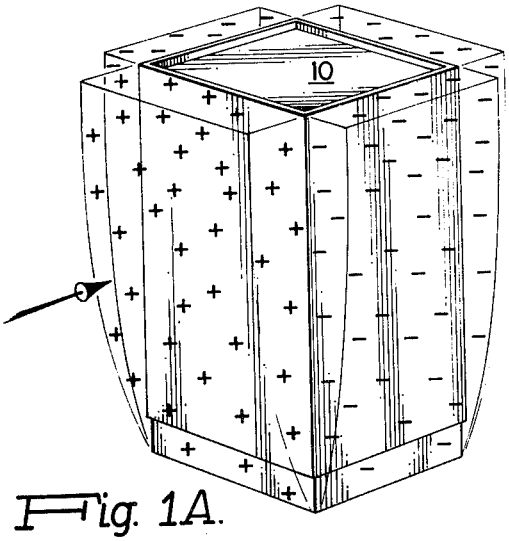

This invention relates to illumination and ventilation systems in general and more particularly to a gravity and wind-pressure actuated illumination and ventilation system for buildings and other enclosures.

Various systems have been proposed for providing ventilation and/or illumination for the interiors of buildings and other enclosures, through the use of louvered units. Representative examples are shown in the following U.S. Pat. Nos. 4,255; 18,100; 90,180; 101,313; 121,633; 141,541; 614,368; 638,503; 757,465; 779,653; 1,672,291; and 3,521,546.

A number of the ventilation systems disclosed in these prior art patents utilize an interlocking arrangement between the ventilating units on opposite sides of a building or enclosure. For example, see U.S. Pat. Nos. 4,255; 18,100; 101,313; 121,633; 14,541; 614,368 and 757,465.

Some of the above mentioned prior art patents have the adjacent blades of a single closure unit interlocked, examples being U.S. Pat. Nos. 4,255; 90,180; and 779,653.

Other ventilating designs shown in the above mentioned prior art patents employ interlocked louvers in a single closure unit examples being U.S. Pat. Nos. 4,255; 90,180; and 779,653.

The interlocking arrangements in the above mentioned patents are unduly complicated, sources of unnecessary friction and relatively expensive to implement.

Some of the above mentioned prior art patents have only one blade per closure unit and even one closure unit per side of enclosure, examples being U.S. Pat. Nos. 101,313; 121,633; 141,541; 638,503; 757,465; and 779,653.

One of the above mentioned prior art patents, U.S. Pat. No. 1,672,291 while not having interlocked adjacent or opposite-side blades, needs stops to prevent each blade from opening past a desired point, needs counter weights to keep each blade in an open position, uses angled fixed louvers for providing rain protection. Furthermore, this patent can not work as anticipated, for when the blades are in an open position, the pressure on each side of each windward blade will be the same because there will be an equal amount of air flowing at the same speed on each side of each windward blade in a direction which is parallel to the blades in their "open" position. That is, the so-called automatically movable blades of this design will have no motivating closure force.

Another of the above mentioned prior art patents, U.S. Pat. No. 638,503, besides having only one blade and one closure unit per side, is incapable of having its leeward and nonwindward openings increased as a result of outward pressures on the leeward and nonwindward sides.

Another of the above mentioned prior art patents, U.S. Pat. No. 3,521,546, while having a plurality of independent blades per side, is primarily intended as a pressure equalizing system. The alternative of this prior art patent which can be used for ventilation (FIG. 2) can not be closed, and rain and snow will enter the windward side when strong winds exist.

It is accordingly a general object of this invention to provide a relatively frictionless, simple, and inexpensive, automatically operated ventilation and illumination systems for buildings and other enclosures.

It is a specific object of this invention to provide an illumination and ventilation system which is automatically responsive to the extent of needs for closing and opening closure units to suit almost all types of climatic requirements and building or enclosure uses.

It is a specific object of this invention to provide closure units for buildings and enclosure which: will have their leeward and nonwindward openings increased when rain and other particles do not tend to enter such closure units, and which will have their windward openings decreased and even closed when rain or other particles tend to enter the windward closure units.

It is therefore a specific object of this invention that it can be used for the automatic and inexpensive control of large areas of high-level openings which need protection from rain, snow, dust or hail.

It is also an object of the present invention to provide an illumination and ventilation system which is automatically actuated by gravitational forces and wind pressures to suit the very different needs of buildings or enclosures.

It is a specific object of this invention to provide a very inexpensive capital-cost means of economically and automatically controlling the opening and closing of large areas of closure units.

It is a feature of this invention that the illumination and ventilation system can be adjusted to accommodate various wind velocities so that the closure units of the ventilation system will respond to any required predetermined wind velocity.

Figure 2:
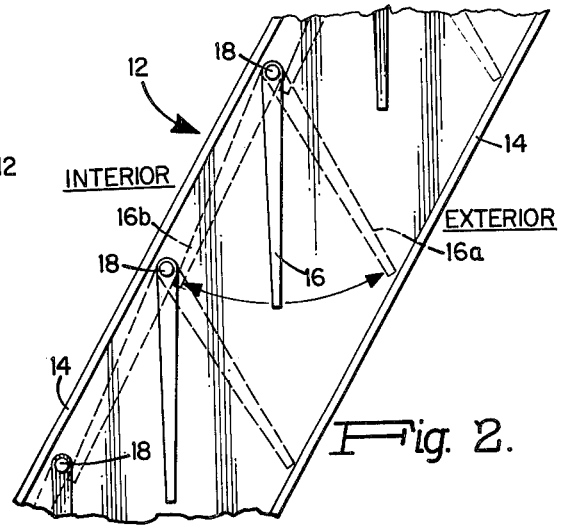
Figure 3:
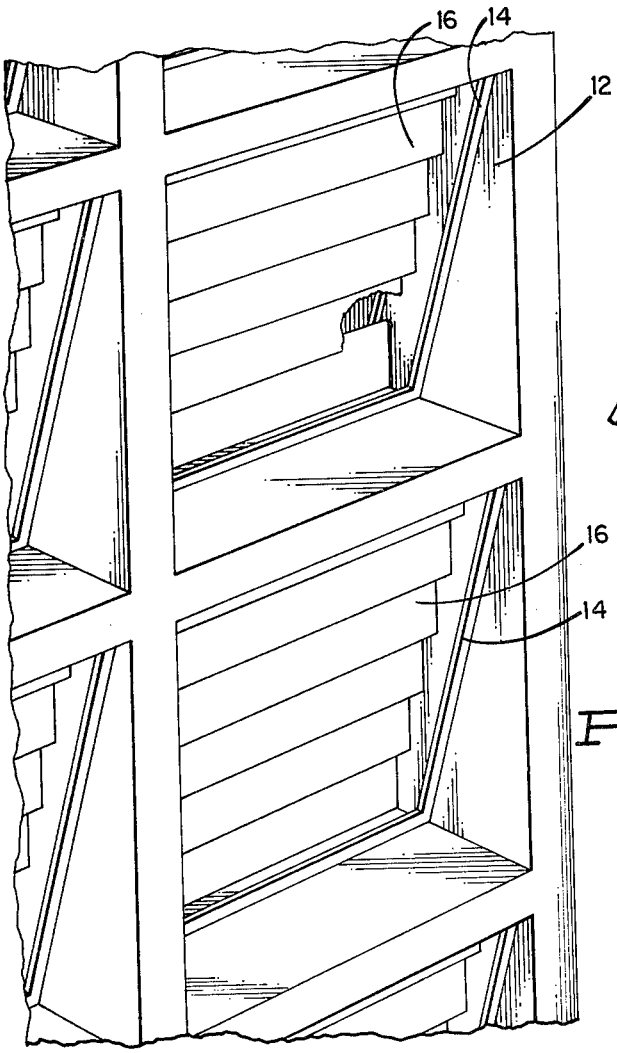
Figure 4A:
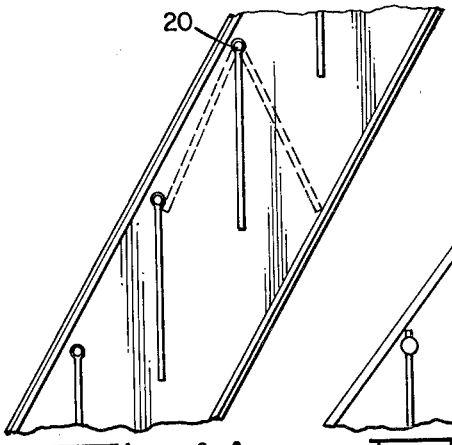
Figure 4B:
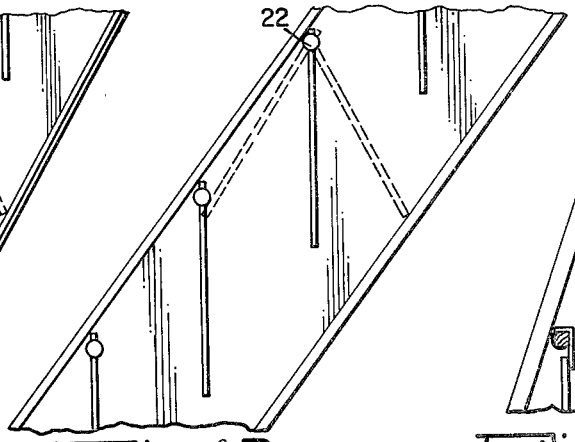
Figure 4C:
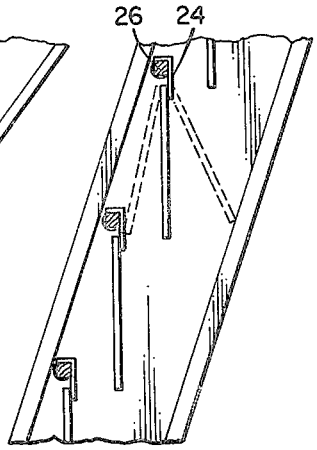
Figure 5:
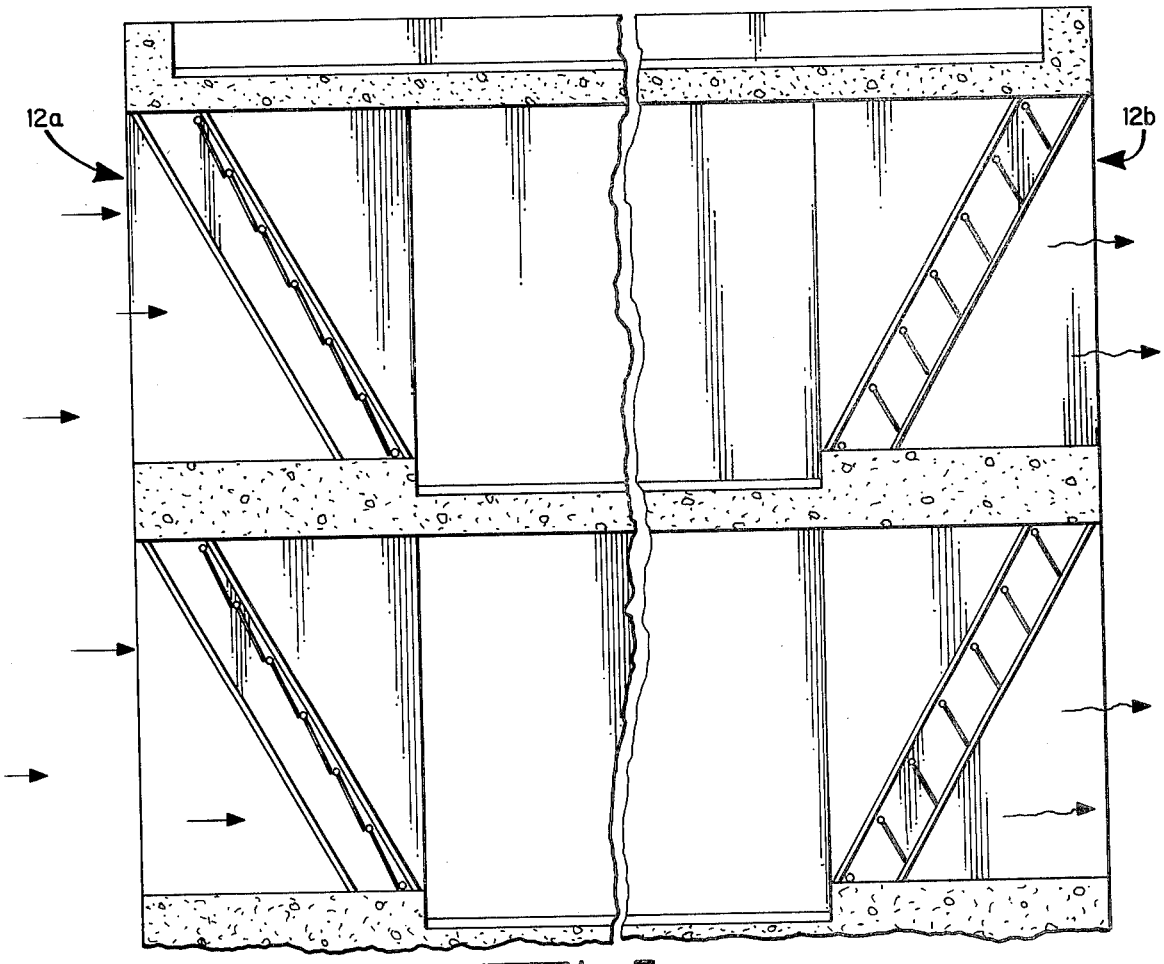

These and other objects and features of the present invention will be best understood from a detailed description of a preferred embodiment thereof, selected for purposes of illustration and shown in the accompanying drawings, in which:

FIG. (1A) is a diagrammatic illustration of the outward and inward wind pressures on the sides of a building or enclosure when the wind is perpendicular to one side as shown in FIG. (1A):

FIG. (1B) is a similar diagrammatic illustration of wind pressures on the sides of a building or enclosure when the wind impinges upon one corner of the building or other enclosure as indicated by FIG. (1B):

FIG. (2) is a view in side elevation of a portion of a closure unit constructed in accordance with one alternative for the present invention showing a plurality of pivotally mounted, downwardly, extending, movable closure unit blades;

FIG. (3) is a view in perspective of a side of a building or other enclosurre, showing a plurality of the closure units of FIG. (2) mounted therein; show FIGS. (4A), (4B), and (4C) are views in side elevation, showing three configurations of the closure units of FIG. (2) with three different slopes of the planes containing the pivot axii of the movable blades. And these diagrams also shown some alternative methods of making and mounting the movable blades;

FIG. (5) is a view in side elevation of a building showing the closure units of FIG. 2 mounted on the windward and leeward sides of the building.

Turning now to the drawings, and particularly to the wind pressure diagrams of FIGS. (1A) and (1B) thereof, the inward and outward wind pressures on the sides of a building or other enclosure are depicted by plus (+) and minus (−) symbols which indicate inward (positive) and outward (negative) pressures respectively. The intensity of the wind is diagrammatically illustrated in these Figures by near parabolic curves and the thickness of the space diagrams containing the plus and minus symbols. It can be seen from an inspection of these Figures that the wind pressures normally increase as a function of their distance above the ground.

Figure 1B:
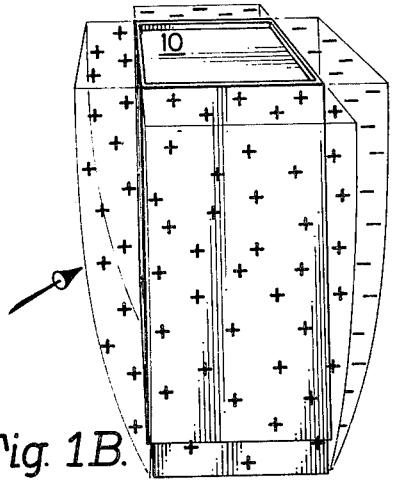

The wind force illustrated in FIGS. 1A and 1B are employed in the present invention in conjunction with gravitational forces to automatically actuate the illumination and ventilation closure units as indicated generally in FIGS. (2) and (3) by the reference numeral 12. Each closure unit comprises a frame element, 14; within the frame are pivotally mounted a plurality of downwardly extending, movable blades, 16. The blades, 16, are movable in inward and outward directions from a central "Rest" position indicated in FIG. (2) and the solid lines. In the "Rest" or "Half-Opened" position the only force acting on the blades, 16, is the force of gravity. in the "Fully Opened" position indicated by the broken lines and reference numeral 16*a*, the blade 16, is actuated outward by the negative outward pressure of the nonwindward forces. Similarly, in the "Closed" position indicated by the broken lines and reference numeral 16*b*, the pivotally mounted blade is subject to the positive inward pressure of the windward winds.

The three positions of the pivotally mounted blades, 16, shown in FIG. (2) illustrate the situations for three ambient conditions: (1) no wind forces; (2) inwardly acting positive windward forces from windward winds; and, (3) outwardly acting negative forces on the nonwindward and leeward sides of a building or enclosure. In the "Rest" or "Half-Opened" position shown by the continuous lines in FIG. (2), the pivotally mounted closure unit blades assume a gravity controlled vertical position. In this position, air will move into and out of the building by convection. In the case of inward acting windward winds, the closure unit blades will be closed against each other as shown by the position identified by the reference numerals 16*b*. In this position, no air, rain, dust or snow can enter the building from the windward side. It should be noted that in this position that the closure unit blades 16 overlap each other to provide a tight seal. Expressed in slightly different terms it can be seen that the downward extending closure blades extend downward beyond the pivot axis of the next suceeding lower blade with the exception of the lowermost blade. In addition, the pivot axis of each blade is vertically and horizontally suitably spaced from the pivot axis of the adjacent blades.

In the third position indicated by the broken lines and the reference numeral 16*a* in FIG. 2, the outward acting nonwindward or leeward winds keep the closure unit blades as far open as possible by the outward suction forces of wind eddies on the leeward and nonwindward sides. Because these openings are on the suction sides, rain, snow and dust will be sucked away from of the nonwindward and leeward sides and will therefore not enter such sides.

The pivot axii, 18, of the closure unit blades, 16, are parallel to each other and lie in a sloping plane with resect to the horizontal ground plane. By varying the slope of the plane containing the pivot axii 18, the amount of wind force necessary to close the blades 16 to the position indicated by the reference numeral 16*b* in FIG. (2) can be varied as a function of the wind velocity. The slope of the pivot axii plane can be adjusted by tilting the frame and suitable known mechanisms can be employed to vary the tilt of the frame. For example, manual adjustment by means of push rods, levers, worn gears, or motors which connected to the frame can be employed. In the latter situation, actuation of the motor can be controlled as a function of sensed wind velocity. However, it should be noted that this feature while novel, is optional.

It should be noted that the adjacent and individual blades of each closure unit 16 are each independently movable with respect to each other and even within a particular closure unit frame, and even with respect to any other blades in other closure units. Thus, the closure blades of the units 12*a* and 12*b* shown in FIG. (5), operate completely independently of each other.

The actual pivotal mounting of the closure blades 16 within the frame 16 can be accomplished in a variety of ways. Looking at FIGS. (4A) and (4B), three different methods are illustrated. In FIG. (4A) the blade is shown as a moulded plastic or metal blade with integral pivot 20. In FIG. (4B) the blade is assembled with a separate pivot 22 while in FIG. (4C) the blade is secured by means of a tape hinge 24 to a rectangular header stiffner 26 which in turn is pivotally mounted to the frame 14. Other alternative methods for making and pivotally mounting the blades with respect to the frame and various frame constructions can be employed in the practice of the present invention.

Having described in detail a preferred embodiment of my invention, it will now be apparent to those skilled in the art that numerous modifications can be made therein without departing from the scope of the invention as defined in the appended claims.

What I claim and desire to secure by Letters Patent of the United States is:

1. A gravity and wind-pressure actuated illumination and ventilation closure unit for buildings comprising:

a frame means; and, a plurality of independently movable, downwardly, extending, blades pivotally mounted within the frame means with the pivot axii of said blades being parallel and, lying in a sloping plane when the closure unit is installed in the side of a building, said blades being movable from a partially open, gravity controlled position to either a closed position or a fully open position as a function of positive or negative wind pressure, respectively.

2. The closure unit of claim 1 wherein said pivotally mounted closure unit blades are vertically and horizontally spaced from each other with a portion of each blade, except the lowermost blade, vertically overlapping a portion of the next lower blade.

3. A gravity and wind-pressure actuated illumination and ventilation system for a building, said system comprising:

at least one closure unit mounted in a side of a building, said closure unit comprising:

a frame means; and, a plurality of independently movable, downwardly extending blades, pivotally mounted within the frame means with the pivot axii of said blades being parallel and, lying in a sloping plane, said blades being movable from a partially open, gravity controlled position to either a closed position or a fully open position as a function of positive or negative wind pressure, respectively.

4. The illumination and ventilation system of claim 3 wherein the said pivotally mounted closure unit blades are vertically and horizontally spaced from each other with a portion of each blade, except the lowermost blade, vertically overlapping a portion of the next lower blade.

5. The illumination and ventilation system of claim 3 wherein said pivotally mounted closure unit blades are free to rotate about the pivot axii in both clockwise and counterclockwise directions.

6. The illumination and ventilation system of claim 3 wherein each one of the said pivotally mounted closure unit blades is independently rotatable about its pivot axis.

7. A gravity and wind pressure actuated illumination and ventilation system for a building having windward and leeward sides, said system comprising:

a windward closure unit mounted on the windward side of the building comprising:
frame means;
a plurality of movable, downwardly extending blades pivotally mounted within the frame means with the pivot axii of said blades being parallel and lying in a sloping plane; and, a leeward closure unit mounted on the leeward side of the building comprising:
frame means;
a plurality of movable, downwardly extending blades pivotally mounted within the frame means with the pivot axii of said blades being parallel and lying in a sloping plane, wherein said windward and leeward closure units operate independently of each other, and wherein the windward closure unit blades close under wind pressure on the windward side of the building while the leeward closure unit blades open under such wind condition.

8. A gravity and wind pressure actuated illumination and ventilation system for a building having windward and leeward sides, said system comprising:

a windward closure unit mounted on the windward side of the building comprising:
frame means;
a plurality of movable, downwardly extending blades pivotally mounted within the frame means with the pivot axii of said blades being parallel and lying in a sloping plane; and, a leeward closure unit mounted on the leeward side of the building comprising:
frame means;
a plurality of movable, downwardly extending blades pivotally mounted within the frame means with the pivot axii of said blades being parallel and lying in a sloping plane, wherein said windward and leeward pivotally mounted closure unit blades are free to rotate about the pivot axii in both clockwise and counterclockwise directions according to wind and gravitational forces which coincide with the need for opening and closing such closure units.

9. The illumination and ventilation system of claim 8 wherein each one of said windward and leeward pivotally mounted closure unit blades is independently rotatable about its pivot axis.

* * * * *